US006821323B1

(12) United States Patent
Bell et al.

(10) Patent No.: US 6,821,323 B1
(45) Date of Patent: Nov. 23, 2004

(54) PROCESS FOR THE NON-GALVANIC TIN PLATING OF COPPER OR COPPER ALLOYS

(75) Inventors: Jane Bell, Solingen (DE); Joachim Heyer, Neunkrichen-Seelscheid (DE); Jürgen Hupe, Langenfeld (DE); Ingo Kalker, Solingen (DE); Marlies Kleinfeld, Wuppertal (DE)

(73) Assignee: Enthone Inc., West Haven, CT (US)

( * ) Notice: Subject to any disclaimer, the term of this patent is extended or adjusted under 35 U.S.C. 154(b) by 84 days.

(21) Appl. No.: 10/129,998

(22) PCT Filed: Nov. 9, 2000

(86) PCT No.: PCT/US00/30983

§ 371 (c)(1),
(2), (4) Date: Jul. 31, 2002

(87) PCT Pub. No.: WO01/34310

PCT Pub. Date: May 17, 2001

(30) Foreign Application Priority Data

Nov. 12, 1999 (DE) ..... 199 54 613

(51) Int. Cl.[7] ..... C23C 18/31
(52) U.S. Cl. ..... 106/1.12; 106/1.25; 427/436
(58) Field of Search ..... 106/1.12, 1.25; 427/436; 428/457

(56) References Cited

U.S. PATENT DOCUMENTS

| | | | | | |
|---|---|---|---|---|---|
| 5,160,422 | A | | 11/1992 | Nishimura et al. | |
| 5,217,751 | A | | 6/1993 | King et al. | |
| 5,266,103 | A | | 11/1993 | Uchida et al. | |
| 5,435,838 | A | | 7/1995 | Melton et al. | |
| 5,554,211 | A | * | 9/1996 | Bokisa et al. | 106/1.22 |
| 6,063,172 | A | * | 5/2000 | Bokisa et al. | 106/1.22 |
| 6,099,713 | A | * | 8/2000 | Yanada et al. | 205/253 |
| 6,183,545 | B1 | * | 2/2001 | Okuhama et al. | 106/1.18 |
| 2002/0153260 | A1 | * | 10/2002 | Egli et al. | 205/300 |

FOREIGN PATENT DOCUMENTS

| | | | |
|---|---|---|---|
| EP | 0715003 | | 6/1996 |
| JP | 02/061073 | * | 3/1990 |
| JP | 10-245683 | | 9/1998 |

OTHER PUBLICATIONS

Derwent abstract of JP02/061073, Mar. 1990.*

* cited by examiner

*Primary Examiner*—Helene Klemanski
(74) *Attorney, Agent, or Firm*—Senniger Powers

(57) ABSTRACT

The invention describes a process for non-galvanic tin plating of copper and copper alloys by precipitation of tin from methanesulphonic acid and tin-containing electrolytes, containing a complexing agent. In describing a process by which a durable tin layer which can be soldered is a created, which, at the same time, prevents liberation of the base material, this invention discloses that the electrolytes have at least one foreign metal added to form a diffusion barrier in the layer.

50 Claims, No Drawings

PROCESS FOR THE NON-GALVANIC TIN PLATING OF COPPER OR COPPER ALLOYS

BACKGROUND OF THE INVENTION

The invention deals with a process for the non-galvanic tin plating of copper or copper alloys by precipitating tin from a tin-containing electrolyte, consisting of methanesulphonic acid and a complexing agent.

Non-galvanic tin precipitation is known from the current state of the art and is commonly used, based both on acidic and alkaline electrolytes. Primarily, copper and copper alloys are tin plated in an ion exchange process, for example pipes, pipe sections and fittings for cold and hot water, battery posts, sanitary connectors as well as conductor frames. As the source of the tin for the electrolytes especially bivalent tin salt is used, such as for example tin chloride, tin sulfate, tin tetrafluorborate or tin methanesulphonate.

The formation of non-galvanically precipitated tin layers on copper and copper alloys is effected by the exchange of copper for tin atoms, whereby the removal of the copper is made possible by a complexing agent.

A generic process is described in DE 197 49 382 A1. The process described there refers to the tin plating of pipes, pipe sections and fittings of copper or a copper alloy by the chemical precipitation of a tin layer. Methanesulphonic acid, tin methanesulphonate, a complexing agent as well as a wetting agent are suggested as electrolyte.

BRIEF SUMMARY OF THE INVENTION

The tin layers produced with the tin precipitation processes known heretofore only grow until no more surface copper can pass through the porous tin layer. The achievable layer thickness is therefore limited to a maximum of 2 $\mu$m. The disadvantage is that a diffusion of metals from the base material, especially of alloy components, can occur which may lead to undesirable effects. For example, copper of a potable water pipe may dissolve and diffuse through the tin and can enter the water, which may have effects detrimental to health. Also, the liberation of lead and zinc from brass base materials, for example, can not be prevented by the precipitation of a generic tin layer. In addition, difficulties with soldering of the surface of tin plated base materials due to the diffusion are a disadvantage.

In order to avoid the above disadvantages it is the purpose of the invention to devise a process for the non-galvanic tin plating of copper or copper alloys by which a durable tin layer which can easily be soldered can be produced which, at the same time, prevents the liberation of the basic material.

As a solution it is proposed by the invention that at least one foreign metal is added to the electrolyte to form a diffusion barrier in the tin layer.

With the process described in the invention, a tin bath is suggested for the formation of a tin layer by chemical precipitation, which contains at least one foreign metal. The addition of foreign metals to the tin bath achieves an advantageous suppression of the diffusion processes, and thus a diffusion barrier is built which prevents the liberation of metals from the base material to a large extent. The advantages thus gained are good soldering characteristics at the surface and good durability of the tin layer.

The formation of a tin layer by the above process therefore not only creates the possibility to produce effective corrosion protection but, moreover, by the use of foreign metals a diffusion-stable tin layer is produced which prevents the liberation of materials from the base layer to a large extent. This is an advantage especially in view of the copper liberation from potable water carrying copper tubing. However, an out-diffusion of lead and zinc from basic brass materials is prevented by a diffusion-stable tin layer.

In accordance with one feature of the invention, a metal of the group silver, bismuth, nickel, titanium, zirconium and indium is suggested as the foreign metal, whereby the use of indium has shown to be especially effective. For the formation of a diffusion barrier within the tin layer, at least one of the above metals is added to the tin bath as a foreign metal.

In accordance with an additional feature of the invention, thiourea and/or its derivative is used as the complexing agent. Thiourea as the complexing agent enables the liberation of positively charged copper ions. A copper thiourea complex forms which is soluble in electrolytes at a temperature of >28° C. As a result of the complexing of the copper, its potential compared to that of tin is reduced. The then more noble tin precipitates, forming a layer of tin on the copper. The liberated copper ions concentrate in the electrolyte, whereby at a copper concentration above 7 g/l economical working is no longer possible since at these concentrations tin is no longer precipitated at satisfactory rates. It is therefore suggested to remove the copper by precipitation of the copper-thiourea compounds in solution in the electrolyte. In this manner, a substantial increase in the useful life of the tin bath may be achieved. The precipitation of the copper-thiourea compounds can be achieved by means of another feature of the invention by filtration.

For the application of the non-galvanic precipitation of diffusion-stable tin layers in accordance with the invention a tin bath is of advantage, which preferably contains the following components:

1. A source of tin,
   preferably a bivalent tin salt, for example tin methanesulfonate, with 1 to 30 g/l of tin in the tin bath;
2. An acid,
   preferably methanesulphonic acid with 5 to 200 g/l in the tin bath, whereby the tin bath assumes a pH value of 0 to 3;
3. A complexing agent,
   preferably thiourea or a derivative in quantities of 10 to 200 g/l;
4. A wetting agent in quantities of 1 to 10 g/l;
5. At least one foreign metal,
   preferably a metal in the group Ag, Bi, Ni, Ti, Zr and In in a proportion of 1 to 500 mg/l in the tin bath.

To apply the process described in the invention, a working temperature of the tin bath of 35 to 80° C. is suggested. In addition, already known measures common to the state of the art can be taken when using the process described. This includes, for example, rinsing, pickling and drying of the work pieces.

Further details regarding the invention follow from the examples below in each of which an electrolyte composition is suggested.

EXAMPLE 1

| | |
|---|---|
| Thiourea | 100 g/l |
| Methanesulphonic acid | 100 g/l |
| Tin methanesulphonate | 5 g/l tin |
| Wetting agent | 5 g/l |
| Bismuth | 30 mg/l |

EXAMPLE 2

| | |
|---|---|
| Thiourea | 100 g/l |
| Methanesulphonic acid | 100 g/l |
| Tin methanesulphonate | 15 g/l tin |
| Wetting agent | 3 g/l |
| Antioxidant | 5 g/l |
| Titanium | 5 mg/l |

EXAMPLE 3

| | |
|---|---|
| Thiourea | 120 g/l |
| Methanesulphonic acid | 140 g/l |
| Tin methanesulphonate | 15 g/l tin |
| Wetting agent | 5 g/l |
| Antioxidant | 5 g/1 |
| Indium | 50 mg/l |

The process described by the invention makes it possible to produce diffusion-stable tin layers by means of chemical precipitation, whereby the diffusion barrier generated by the addition of foreign metals prevents the liberation of metals from the base materials in an advantageous manner. In addition, by using thiourea as complexing agent it becomes possible to remove the copper ions liberated from the copper from the electrolyte by filtration, and thus to achieve a substantially extended useful life. Furthermore, in this manner a substantial acceleration of the process is achieved.

What is claimed is:

1. A bath for non-galvanic plating of a tin layer onto a copper or copper alloy base layer, the bath comprising:

a tin-containing electrolyte;

an acid;

a complexing agent;

a foreign metal which suppresses diffusion of a base layer material through the tin layer; and an antioxidant.

2. The bath of claim 1 wherein the concentration of tin in the bath is 1 to 30 grams/liter.

3. The bath of claim 1 wherein the tin-containing electrolyte comprises a bivalent tin salt.

4. The bath of claim 1 wherein the bivalent tin salt comprises tin methanesulfonate.

5. The bath of claim 1 wherein the bath has a pH of 0 to 3.

6. The bath of claim 1 wherein the acid comprises methanesulfonic acid.

7. The bath of claim 6 wherein the concentration of methanesulfonic acid in the bath is 5 to 200 grams/liter.

8. The bath of claim 1 wherein the complexing agent comprises thiourea or a thiourea derivative.

9. The bath of claim 8 wherein the concentration of thiourea or thiourea derivative is 10–200 grams/liter.

10. The bath of claim 1 further comprising a wetting agent.

11. The bath of claim 1 wherein the concentration of the wetting agent in the bath is 1 to 10 grams/liter.

12. A bath for non-galvanic plating of a tin layer onto a copper or copper alloy base layer, the bath comprising:

a tin-containing electrolyte, wherein the concentration of tin in the bath is 1 to 30 grams/liter;

an acid;

a complexing agent; and a foreign metal which suppresses diffusion of a base layer material through the tin layer, wherein the foreign metal is indium in a concentration of 1 to 500 milligrams/liter.

13. A bath for non-galvanic plating of a diffusion-stable tin layer onto a copper or copper alloy base layer, the bath consisting essentially of thiourea, methanesulfonic acid, tin methanesulfonate, a wetting agent, and bismuth.

14. The bath of claim 13 wherein the concentration, in the bath, of the thiourea is 100 grams/liter, of the methanesulfonic acid is 100 grams/liter, of tin is 5 grams/liter, of the wetting agent is 5 grams/liter, and of the bismuth is 30 milligrams/liter.

15. A bath for non-galvanic plating of a diffusion-stable tin layer onto a copper or copper alloy base layer, the bath consisting essentially of thiourea, methanesulfonic acid, tin methanesulfonate, a wetting agent, an antioxidant, and titanium.

16. The bath of claim 15 wherein the concentration, in the bath, of the thiourea is 100 grams/liter, of the methanesulfonic acid is 100 grams/liter, of tin is 15 grams/liter, of the wetting agent is 3 grams/liter, of the antioxidant is 5 grams/liter, and of the titanium is 5 milligrams/liter.

17. A bath for non-galvanic plating of a diffusion-stable tin layer onto a copper or copper alloy base layer, the bath consisting essentially of thiourea, methanesulfonic acid, tin methanesulfonate, a wetting agent, an antioxidant, and indium.

18. The bath of claim 17 wherein the concentration, in the bath, of the thiourea is 120 grams/liter, of the methanesulfonic acid is 140 grams/liter, of tin is 15 grams/liter, of the wetting agent is 5 grams/liter, of the antioxidant is 5 grams/liter, and of the indium is 50 milligrams/liter.

19. A process for plating a tin layer onto a copper or copper alloy base layer, the process comprising:

contacting the copper or copper alloy base layer with a bath comprising a tin-containing electrolyte, an acid, a complexing agent, and a foreign metal which suppresses diffusion of a base layer material through the tin layer, wherein the concentration of tin in the bath is in the range of 1 to 30 grams/liter and the concentration of foreign metal in the bath is in the range of 1 to 500 mg/L; and non-galvanically precipitating tin and the foreign metal from the bath onto the base layer to thereby form a tin metal layer on the substrate with a diffusion barrier of the foreign metal therein.

20. The process of claim 19 wherein the tin-containing electrolyte comprises a bivalent tin salt.

21. The process of claim 20 wherein the bivalent tin salt comprises tin methanesulfonate.

22. The process of claim 21 wherein the bath has a pH of 0 to 3.

23. The process of claim 22 wherein the acid comprises methanesulfonic acid.

24. The process of claim 23 wherein the concentration of methanesulfonic acid in the bath is 5 to 200 grams/liter.

25. The process of claim 24 wherein the complexing agent comprises thiourea or a thiourea derivative and the concentration of the complexing agent in the bath is 10–200 grams/liter.

26. The process of claim 19 wherein the foreign metal is selected from the group consisting of silver, bismuth, nickel, titanium, zirconium, indium, and mixtures thereof.

27. The process of claim 19 wherein the bath further comprises a wetting agent and the concentration of the wetting agent in the bath is 1 to 10 grams/liter.

28. The process of claim 19 wherein the bath further comprises a wetting agent.

29. The process of claim 19 wherein the foreign metal is indium.

30. The process of claim 19 wherein the foreign metal is indium and the bath further comprises a wetting agent.

31. The process of claim 19 wherein the foreign metal is indium and the bath further comprises an antioxidant.

32. The process of claim 19 wherein the foreign metal is indium and the bath further comprises an antioxidant and a wetting agent.

33. The process of claim 19 wherein the foreign metal is bismuth.

34. The process of claim 19 wherein the foreign metal is bismuth and the bath further comprises a wetting agent.

35. The process of claim 19 wherein the foreign metal is bismuth and the bath further comprises an antioxidant.

36. The process of claim 19 wherein the foreign metal is bismuth and the bath further comprises an antioxidant and a wetting agent.

37. A process for plating a tin layer onto a copper or copper alloy base layer, the process comprising:

contacting the copper or copper alloy base layer with a bath at a pH of 0 to 3 comprising tin methanesulfonate, methanesulfonic acid, a complexing agent of thiourea or a thiourea derivative in a concentration in the bath between 10 and 200 g/L, a wetting agent in a concentration in the bath between 1 and 10 g/L, an antioxidant, and a foreign metal selected from the group consisting of silver, bismuth, nickel, titanium, zirconium, indium, and mixtures thereof; and non-galvanically precipitating tin and the foreign metal from the bath onto the base layer.

38. A process for plating a tin layer onto a copper or copper alloy base layer, the process comprising:

contacting the copper or copper alloy base layer with a bath comprising a tin-containing electrolyte, an acid, a complexing agent, an antioxidant, and a foreign metal which suppresses diffusion of a base layer material through the tin layer; and non-galvanically precipitating tin and the foreign metal from the bath onto the base layer.

39. The process of claim 38 wherein the tin-containing electrolyte comprises a bivalent tin salt.

40. The process of claim 39 wherein the bivalent tin salt comprises tin methanesulfonate.

41. The process of claim 38 wherein the bath has a pH of 0 to 3.

42. The process of claim 38 wherein the complexing agent comprises thiourea or a thiourea derivative and the concentration of the complexing agent in the bath is 10–200 grams/liter.

43. The process of claim 38 wherein the foreign metal is selected from the group consisting of silver, bismuth, nickel, titanium, zirconium, indium, and mixtures thereof.

44. The process of claim 38 wherein the bath further comprises a wetting agent.

45. The process of claim 38 wherein the foreign metal is indium.

46. The process of claim 38 wherein the foreign metal is bismuth.

47. A process for plating a tin layer onto a copper or copper alloy base layer, the process comprising:

contacting the copper or copper alloy base layer with a bath consisting essentially of thiourea, methanesulfonic acid, tin methanesulfonate, a wetting agent, an antioxidant, and titanium; and non-galvanically precipitating tin and titanium from the bath onto the base layer whereby the titanium diffusion of material from the base layer material through the tin layer.

48. The process of claim 47 wherein the concentration, in the bath, of the thiourea is 100 grams/liter, of the methanesulfonic acid is 100 grams/liter, of tin is 15 grams/liter, of the wetting agent is 3 grams/liter, of the antioxidant is 5 grams/liter, and of the titanium is 5 milligrams/liter.

49. A process for plating a tin layer onto a copper or copper alloy base layer, the process comprising:

contacting the copper or copper alloy base layer with a bath consisting essentially of thiourea, methanesulfonic acid, tin methanesulfonate, a wetting agent, an antioxidant, and indium; and non-galvanically precipitating tin and titanium from the bath onto the base layer whereby the titanium diffusion of material from the base layer material through the tin layer.

50. The process of claim 49 wherein the concentration, in the bath, of the thiourea is 120 grams/liter, of the methanesulfonic acid is 140 grams/liter, of tin is 15 grams/liter, of the wetting agent is 5 grams/liter, of the antioxidant is 5 grams/liter, and of the indium is 50 milligrams/liter.

* * * * *